United States Patent [19]

Mansker

[11] Patent Number: 4,552,654

[45] Date of Patent: Nov. 12, 1985

[54] SAMPLE CONCENTRATING CABLE JIG

[76] Inventor: William L. Mansker, 8704 Gutierrez NE., Albuquerque, N. Mex. 87111

[21] Appl. No.: 595,476

[22] Filed: Mar. 30, 1984

[51] Int. Cl.[4] ..... B03B 4/00

[52] U.S. Cl. ..... 209/425; 209/437; 209/504

[58] Field of Search ..... 209/425, 420, 404, 405, 209/437, 365 R, 504, 315; 24/273; 74/50

[56] References Cited

U.S. PATENT DOCUMENTS

| | | | |
|---|---|---|---|
| 143,219 | 9/1873 | Bradford | 209/425 |
| 388,464 | 8/1888 | Talley | 209/437 X |
| 427,249 | 5/1890 | Bilharz | 209/425 |
| 430,335 | 6/1890 | Calkins | 209/404 X |
| 899,441 | 9/1908 | Taylor | 209/425 X |
| 1,230,477 | 6/1917 | Green | 209/420 X |
| 1,312,429 | 8/1919 | Barbee et al. | 209/425 |
| 2,663,923 | 12/1953 | Mattingly | 24/273 |
| 2,709,521 | 5/1955 | Fisher | 209/365 R X |
| 3,109,808 | 11/1963 | Greenwell | 209/315 X |
| 3,313,415 | 4/1967 | Swenson et al. | 209/420 X |

FOREIGN PATENT DOCUMENTS

| | | | |
|---|---|---|---|
| 9800 | of 1843 | United Kingdom | 209/425 |

*Primary Examiner*—Richard L. Chiesa
*Attorney, Agent, or Firm*—Harvey B. Jacobson

[57] ABSTRACT

A support frame is provided for support in a body of water with the level of the water disposed, generally, at a predetermined level on the frame and a mount is provided and supports a generally horizontal sample support screen therefrom. The mount includes portions thereof horizontally spaced apart about the support screen and inward of corresponding peripherally spaced portions of the support frame. A purality of elongated, coiled expansion springs extend and are connected between the mount portions and the aforementioned corresponding peripherally spaced portions of the support frame in at least a partially tensioned state and support the mount and screen from the frame. Lift structure is connected between the frame and the mount operative to intermittently direct and release upward thrust on the mount and the expansion springs support the screen, when the latter is in a static condition, at a level at least slightly below the aforementioned predetermined level. A sample hopper is supported from the frame above the screen and includes a lower variably openable gravity outlet spaced above the aforementioned predetermined level in substantially vertical alignment with the center of the screen.

7 Claims, 6 Drawing Figures

SAMPLE CONCENTRATING CABLE JIG

BACKGROUND OF THE INVENTION

There are many instances in which rapid field evaluation of heavy mineral content of various ground samples is desired. While various different forms of vibratory heavy sample concentrators heretofore have been designed, most of these previously known devices have included vibratory screen structures designed to be oscillated back and forth between their limits of movement through relatively reversed but otherwise substantially identical cycles of operation. However, it has been found that variances in the speed of movement occurring during the relatively reversed cycles of operation of a vibratory screen may enable more effective concentration of the heavy components of a soil sample. Accordingly, a need exists for a vibratory sample concentrator which may be effectively driven through its reverse cycles of movement at varying speeds in order to allow the most effective concentration of heavier components.

Examples of vibratory heavy soil component concentrators and separators including some of the general structural and operational features of the instant invention are disclosed in U.S. Pat. Nos. 388,464, 430,335, 1,230,477, 2,663,923, 2,709,521, 3,109,808 and 3,313,415.

BRIEF DESCRIPTION OF THE INVENTION

The cable jig of the instant invention includes a support frame for support in a body of water and a horizontal sample support screen suspended from the frame by somewhat tensioned generally horizontal and outwardly radiating coiled tension springs connected between selected peripheral portions of the screen assembly and corresponding peripheral portions of the frame disposed outwardly of the screen. A plurality of lift cables including substantially vertical lower end portions are attached at their lower ends to substantially equally peripherally spaced portions of the screen assembly and structure is supported from the frame for intermittently applying and releasing simultaneous upward pulls on the cables.

In the form of the invention illustrated in the drawings the upper end portions of the cable are attached to one of the arms of a bell crank oscillatably supported from the frame and the other bell crank arm comprises a manual lever by which the bell crank may be oscillated. Angular displacement of the bell crank in one direction effects an upward thrust on the screen assembly and release of manual pressure on the bell crank allows the expansion springs to pull the screen assembly back down to its original position. Hence, the rate of upward movement of the screen may be readily varied and the screen may be allowed to be pulled downwardly by the expansion springs or manual pressure may be applied to the bell crank to slow the downward movement of the screen or to increase the rate of downward movement of the screen relative to that rate of downward screen movement accomplished by the springs alone. Also, if desired, motor means may be operatively connected to the bell crank to oscillate the latter, as by a motor-driven crankshaft and connecting rod assembly, to thereby eliminate the necessity of manually oscillating the screen assembly.

The main object of this invention is to provide a concentrator constructed in a manner whereby the rate of movement of the screen assembly thereof may be varied as desired in both directions of movement of the screen assembly.

Another object of this invention is to provide a concentrator constructed in a manner whereby the oscillating screen thereof may be readily disposed immediately beneath the surface of a body of water.

Yet another object of this invention is to provide a concentrator including various components thereof which are removably joined together and which may be disassembled for transport in a compact state.

Another very important object of this invention is to provide a concentrator of lightweight construction and thus which may be back-packed to remote locations.

Another object of this invention is to provide a concentrator including structure for automatically feeding a granular fluent sample to the center of the screen assembly of the concentrator at a substantially constant adjusted rate.

A final object of this invention to be specifically enumerated herein is to provide a concentrator in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
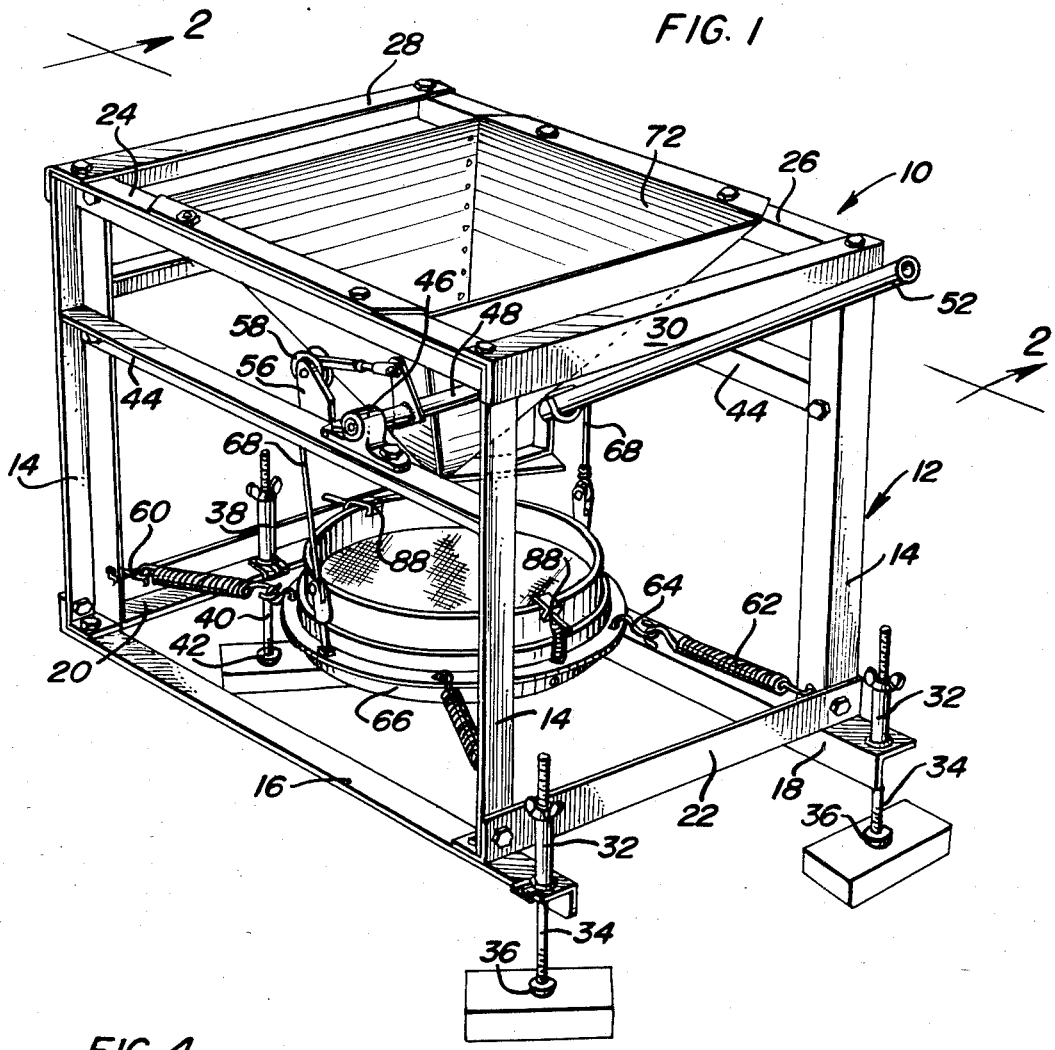
FIG. 1 is a perspective view of the concentrator.
Figure 4:
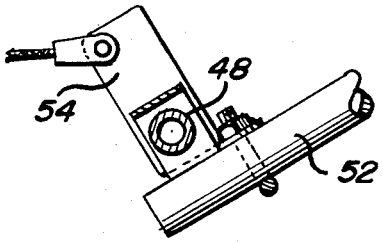
FIG. 4 is a fragmentary enlarged vertical sectional view fragmentarily illustrating the actuating bell crank of the concentrator.

Referring now more specifically to the drawings the numeral 10 generally designates the jig of the instant invention and which includes a generally parallelepiped main frame referred to in general by the reference numeral 12. The frame 12 includes four aluminum angle iron corner posts 14 interconnected at their lower ends by a pair of opposite side longitudinal aluminum angle irons 16 and 18 and opposite end transverse aluminum angle irons 20 and 22. The angle irons 20 and 22 are removably bolted to the lower ends of the legs 14 and the opposite ends of the angle irons 16 and 18 are removably bolted to the adjacent ends of the angle irons 20 and 22. The upper ends of the posts or legs 14 are interconnected by opposite side longitudinal aluminum angle irons 24 and 26 and opposite end transverse aluminum angle irons 28 and 30. The angle irons 24 and 26 are removably bolted to the upper ends of the posts 14 and the opposite ends of the angle irons 28 and 30 are removably bolted to the adjacent ends of the angle irons 24 and 26.

One pair of ends of the angle irons 16 and 18 project endwise outwardly beyond the end transverse angle iron 22 and support upstanding sleeves 32 therefrom. The sleeves 43 slidingly and adjustably receive upstanding support legs 34 therethrough provided with lower end foot portions 36. In addition, the central portion of the angle iron 20 includes an upstanding sleeve 38 through which an upstanding third leg 40 is slidingly and adjustably received having an enlarged foot portion 42 on its lower end. Accordingly, three legs 34 and 40 may be suitably adjusted to support the frame 12 in horizontal position, even on uneven ground.

The upper end portions of the legs 14 disposed on opposite sides of the frame 12 are interconnected by additional longitudinal aluminum angle irons 44 and corresponding end portions of the angle irons 44 mount aligned journal blocks 46 which oscillatably support the opposite ends of a transverse operating shaft 48. The longitudinal mid-portion of the operating shaft 48 has an operating lever 52 supported therefrom and the opposite ends of the shaft 48 have a pair of short levers 54 mounted thereon. In addition, each of the angle irons 44 includes a mount 56 supported therefrom and a pulley wheel 58 is journaled from each mount 56.

The lower end of each leg 14 has an S-shaped hook 60 removably supported therefrom and one end of an elongated expansion spring 62 is removably engaged with each hook 60. The other ends of the expansion springs 62 are removably engaged with a second set of S hooks 64 removably engaged with peripherally spaced portions of a mounting ring 66 and the springs 62 are at least slightly expanded. Thus, the mounting ring 66 is supported centrally between the legs 14 by the expansion springs 62.

A pair of cables 68 have one pair of corresponding ends anchored to the short lever arms 54, their mid-portions trained over the pulley wheels 58 and the other pair of ends thereof removably anchored to diametrically opposite side portions of the mounting ring 66 as at 70. Thus, the lever 52 may be oscillated back and forth in order to vertically reciprocate the mounting ring 66.

A generally inverted pyramid-shaped hollow hopper 72 is mounted from and between the angle irons 24 and 26 and includes a lower open apex portion 74 with which a flow discharge controlling plate 76 is operatively associated. The plate 76 is oscillatably supported from a bracket 78 mounted from one side of the hopper 72 and a spring-biased pivot pin assembly 80 is utilized to effect the pivotal connection between the plate 76 and the bracket 78. The pivot pin assembly 80 is passed through a mounting bore 82 formed in the plate 76 and one end portion 84 of the plate 76 includes three graduated size apertures 86 formed therein. Each of the apertures 86 may be registered with the open apex portion 74 in order to control the rate of discharge of material through the open apex portion 74 from the hopper 72.

The mounting ring 66 includes diametrically opposite spring-mounted clips 88 supported therefrom and the clips 88 removably anchor an upwardly opening generally cylindrical peripheral wall-equipped screen assembly 90 therefrom including a screen wire bottom 92.

Figure 2:
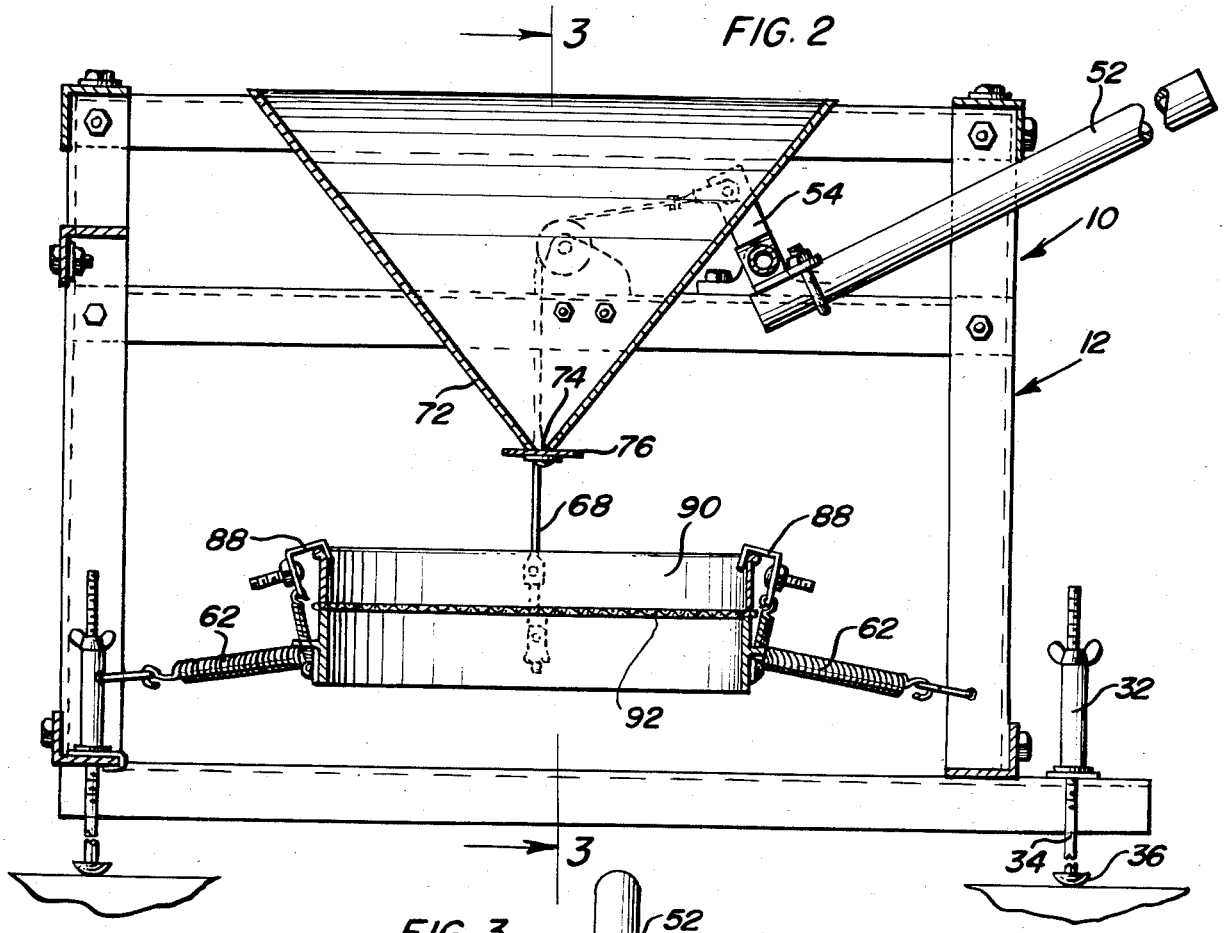
FIG. 2 is an enlarged vertical sectional view taken substantially upon the plane indicated by the section line 2—2 of FIG. 1.
Figure 3:
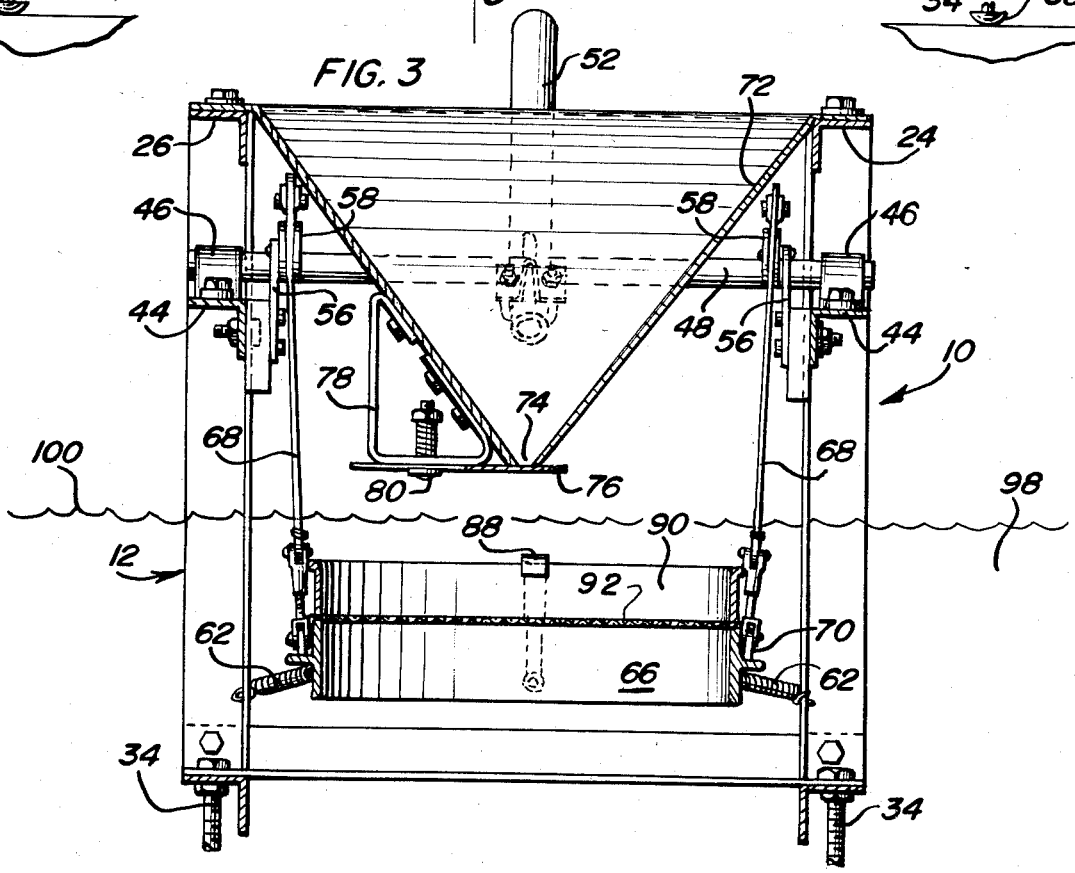
FIG. 3 is a fragmentary vertical sectional view taken substantially upon the plane indicated by the section line 3—3 of FIG. 2.

From FIG. 2 of the drawings it will be noted that the cantilever support of the operating lever 52 exerts a minor upward thrust on the cables 68 in order that the mounting ring 66 is slightly elevated relative to the outermost ends of the supportive springs 62. Of course, if the screen assembly 90 contains alluvial or other samples therein the weight of such samples will offset some of the upward thrust applied to the cables 68 by the operating lever 52 and the mounting ring 66 will be disposed at generally the same height as the remote ends of the springs 62.

Figure 5:
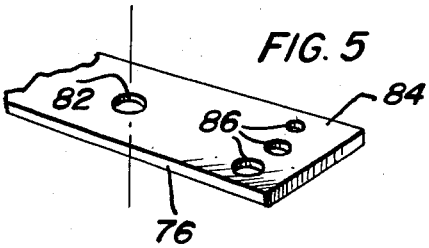
FIG. 5 is a fragmentary perspective view illustrating the variably positionable sample feed rate controlling discharge gate for the sample hopper of the concentrator.
Figure 6:
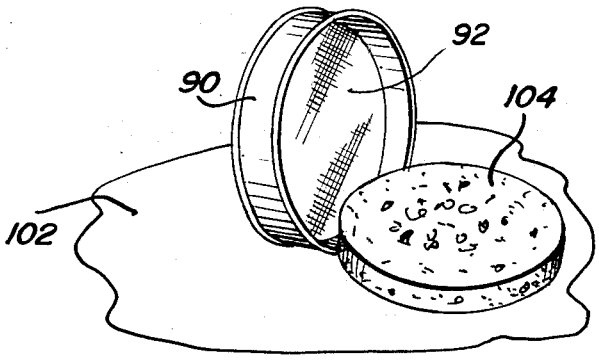
FIG. 6 is a perspective view illustrating the manner in which a "cake" sample generated by operation of the concentrator may be removed from the screen assembly of the concentrator in inverted position upon a suitable horizontal surface.

In operation, a sample to be jigged is placed within the hopper 72 and the frame 12 is positioned in a body of water 98 with the surface lever 100 of the water 98 disposed intermediate the lower open apex portion 74 of the hopper 72 and the screen assembly 90. Thereafter, the plate 76 is adjusted to control the flow rate of the sample from the hopper 72 down toward the screen assembly 90 and the operating lever or arm 52 may be caused to oscillate back and forth in order to alternately raise and lower the screen assembly 90 within the water 98 below the surface level 100 thereof. Such up-and-down oscillation of the screen assembly 90 may be termed as "jigging" and results in the heavier portions of the sample disposed within the screen assembly 90 to collect in the central, lower portion of the screen assembly 90 against the screen bottom 92 thereof. When a jigging operation has been completed, the spring clips 88 are released, the screen assembly 90 is removed and may be inverted upon a suitable support surface such as surface 102 in FIG. 5. In this manner, a "cake" 104 of sample is deposited upon the surface 102 with the heavier portions of the cake sample disposed at the central, upper surface of the cake 104.

By performing the jigging operation within the body of water 98 below the surface level 100 thereof the considerably lighter particles of the sample being jigged are floated upward and out of the screen assembly 90.

Because of the unique manner in which the mounting ring 66 is spring-mounted, the screen assembly 90 may be elevated by applying a downward force on the free end of the operating lever or arm 52 and thereafter releasing all downward pressure to allow the expansion springs 62 to return the mounting ring 66 to its static position. Of course, in such instance the rate of downward movement of the operating lever 52 may be varied as desired. On the other hand, the rate of upward movement of the operating lever 52 may be slowed below that rate accomplished by the expansion spring 62 merely by applying light downward pressure on the lever 52 as it is returned to the static position thereof under the biasing action of the springs 62. However, the rate of return of the screen assembly 90 from an elevated position toward its lower static position may be accelerated over the normal return rate under the biasing action of the springs 62 by applying upward pressure on the lever or arm 52 after applying the aforementioned downward pressure thereon. Accordingly, it may be seen that the rate of up-and-down movement of the screen assembly 90 may be varied as desired. Also, although it is desirable to actuate the operating lever or arm 52 manually, it should be apparent that the operating lever 52 could be oscillated by a simple crank and connecting rod assembly from a driven rotary shaft.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A sample concentrator jig including an open support frame for support in body of water with the level of the water disposed, generally, at a predetermined level on said frame, a mount, a generally horizontal sample support screen supported from said mount, said mount including portions thereof horizontally spaced apart about and outward of said support screen, a plurality of generally horizontal elongated coiled expansion springs extending between and having their opposite ends removably anchored to said mount portions and to corresponding peripherally spaced portions of said support frame with said springs in at least partially tensioned state and supporting said mount and screen from said frame, lift means connected between said frame and mount operative to intermittently direct and release upward thrusts on said mount, said expansion springs supporting said screen at a level at least slightly below said predetermined level, said lift means including a plurality of upstanding elongated and flexible tension member sections having their lower ends anchored relative to said mount portion and means for applying said upward thrusts on the upper end portions of said tension member sections, said tension member section lower ends being evenly spaced about a central area of said support screen, said means for applying said upward thrusts on said tension member sections including an operating shaft oscillatably supported from said frame and extending horizontally thereacross, said operating shaft including a radially outwardly projecting handle and a pair of radially outwardly projecting lever arms adjacent its opposite ends, a pair of pulley wheels journaled from opposite side portions of said frame, substantially vertically spaced above the tension member section lower ends, said tension member sections including mid-portions trained over said pulley wheels, the ends of said tension member sections remote from said mount being anchored relative to said lever arms.

2. The jig of claim 1 wherein said support frame including three peripherally spaced, dependingly supported and infinitely vertically adjustable levelling support feet.

3. The jig of claim 1 wherein said frame supports a downwardly tapering hopper therefrom above said sample support screen and including a lower outlet opening substantially vertically aligned with the central area of said support screen.

4. The jig of claim 3 including flow control means operatively associated with the lower outlet opening of said hopper for variably controlling the flow of fluent material therethrough.

5. The jig of claim 1 wherein said frame supports a downwardly tapering hopper therefrom above said sample support screen and including a lower outlet opening substantially vertically aligned with the central area of said support screen, said operating shaft being disposed to one side of said hopper at an elevation spaced intermediate the upper and lower extremities of said hopper.

6. The jig of claim 5 including flow control means operatively associated with the lower outlet opening of said hopper for variably controlling the flow of fluent material therethrough.

7. The jig of claim 6 wherein said lower outlet opening opens downwardly over the center of said support screen, said flow control means including a horizontal flow control plate mounted from said hopper for oscillation about a vertical axis and with said plate closely underlying and closing said lower outlet opening, said plate including a plurality of different size apertures formed therein spaced along an arcuate path concentric with said axis and registrable with said lower outlet opening.

* * * * *